US006041891A

United States Patent [19]

Fullam et al.

[11] Patent Number: 6,041,891

[45] **Date of Patent: *Mar. 28, 2000**

[54] CLIMBING DEVICE FOR BUILDING FRAMES

[76] Inventors: Peter J. Fullam, 82 Tyler Ave., Sayville, N.Y. 11782; Louis J. Cowin, 820 Erie St., Ronkonkoma, N.Y. 11779

[ * ] Notice: This patent is subject to a terminal disclaimer.

[21] Appl. No.: 09/123,622

[22] Filed: Jul. 28, 1998

Related U.S. Application Data

[63] Continuation of application No. 08/677,074, Jul. 9, 1996, Pat. No. 5,806,628.

[51] Int. Cl.[7] ..... A63B 27/00

[52] U.S. Cl. ..... 182/134; 182/133; 182/135; 182/221

[58] Field of Search ..... 182/3, 4, 133, 182/134, 135, 136, 221

[56] References Cited

U.S. PATENT DOCUMENTS

| | | | |
|---|---|---|---|
| 785,432 | 3/1905 | Perkins | 271/226 |
| 1,031,110 | 7/1912 | Forsyth | 182/134 |
| 1,091,277 | 3/1914 | Bloom | 182/134 |
| 1,312,399 | 8/1919 | Heywood | 182/134 |
| 1,895,571 | 1/1933 | Hein | 182/134 |
| 2,490,923 | 12/1949 | Sasgen | 144/305 |
| 3,004,622 | 10/1961 | Ringer | 182/134 |
| 3,198,470 | 8/1965 | Owens . | |
| 3,336,642 | 8/1967 | Armacost . | |
| 3,523,591 | 8/1970 | Fountain . | |
| 3,724,593 | 4/1973 | O'Keefe | 182/134 |
| 3,807,677 | 4/1974 | Munnoch et al. . | |
| 3,885,647 | 5/1975 | Acosta . | |
| 4,184,568 | 1/1980 | Hillier . | |
| 4,352,409 | 10/1982 | Fountain . | |
| 4,368,800 | 1/1983 | Campbell . | |
| 4,368,801 | 1/1983 | Lewis | 182/134 |
| 4,696,372 | 9/1987 | Fields | 182/134 X |
| 5,165,499 | 11/1992 | Bell . | |
| 5,167,298 | 12/1992 | Porter . | |
| 5,170,898 | 12/1992 | Katz et al. . | |
| 5,238,084 | 8/1993 | Swager . | |
| 5,256,116 | 10/1993 | Robinson . | |
| 5,265,696 | 11/1993 | Casebolt . | |
| 5,307,897 | 5/1994 | Turner et al. . | |
| 5,316,102 | 5/1994 | Bell . | |
| 5,358,068 | 10/1994 | Whitmer . | |
| 5,360,082 | 11/1994 | Bell | 182/3 |
| 5,361,866 | 11/1994 | Bell et al. | 182/3 |
| 5,417,306 | 5/1995 | Robl | 182/134 |

*Primary Examiner*—Alvin Chin-Shue
*Assistant Examiner*—Richard M. Smith
*Attorney, Agent, or Firm*—Dilworth & Barrese

[57] ABSTRACT

A climbing device for attaching to building frames having a pair of jaw members, at least one of which is movable with respect to the other. The spacing between the jaw members may be adjusted, and a lever mechanism is provided to permit the user to detachably affix the climbing device to the frame of a building. A support member is also provided to provide a foot hold for a user so that the user may stand on the device during use. The device may also be connected to a tether or safety line and ultimately connected to a harness attached to the user's body.

8 Claims, 9 Drawing Sheets

CLIMBING DEVICE FOR BUILDING FRAMES

This application is a continuation of Ser. No. 08/677,074 filed Jul. 9, 1996 U.S. Pat. No. 5,806,628.

BACKGROUND OF THE INVENTION

1. Field of the Invention

The present invention relates to devices which attach to frames of structures such as buildings, towers, bridges, and the like both during construction of the structure and after its completion, and in particular relates to a climbing device which is removably attachable to a beam, girder or column of a building frame, such as an I-beam, to provide secure footing or secure attachment for construction personnel to the frame while working on the building.

2. Discussion of the Prior Art

The construction of large steel structures, such as office buildings, bridges, apartment dwellings, and other large multi-story buildings, often times place construction personnel in potentially hazardous locations during both the construction of the building and after its completion, typically during maintenance and general upkeep of the structure. Typically, during construction, after the foundation is laid the building frame is constructed of steel beams having the general cross-section in the shape of an "I", and are typically known as I-beams. As the I-beams are laid in place, they are bolted together to form the frame of the building so that the floors and walls may be put in place as construction of the building moves towards completion.

The I-beams are generally lifted into place by cranes and other large pieces of equipment, and then are joined by steel workers who bolt the I-beams into place at specific locations. The steel workers are typically located in potentially hazardous locations, in that there is no flooring or secure footing in place until the I-beams are actually bolted into place. The steel worker may bolt the I-beams into place while standing in the bucket of a conventional bucket truck, or, in more common situations, the worker must wrap a safety tether or belt around an I-beam or column already in place, and connect the belt or tether to a harness which he wears on his upper body. This makes for a slow and tedious process; each time the worker moves from beam to beam, he must disconnect himself, unwrap the tether from the column or beam, and move to the next location.

A further disadvantage of the existing methods for constructing building frames lies in the fact that most I-beams upon which workers are expected to stand are typically between 8" and 24" wide. The thinner the beam, the less footing the worker has on which to stand and consequently the worker must take great care to secure his footing and tether himself to the existing frame of the building. This slows the construction process, and consequently increases the cost of both the construction of the building, and its related costs such as insurance premiums.

A need exists for a climbing device which permits a worker to releasably attach a climbing device to the I-beam or column, which provides both a secure footing, and a rapid connection for a tether line or safety harness.

SUMMARY OF THE INVENTION

The present invention provides a climbing device which includes a pair of jaw members in which one of the jaw members is movable with respect to the other jaw member to grasp a portion of the building frame such as an I-beam or a column. A support member extends away from the pair of jaws to provide a footing for a user upon which the user may stand while working on the building frame, or use to climb up the I-beam or column. The weight of the user creates a moment force on the jaw members which increases the grasping force of the jaw members on the I-beam or column to further secure the climbing device in place. The jaw members may include grip enhancing members which are raised from the opposed faces of the jaw members to enhance the gripping function of the jaw members on the I-beam or column.

A jaw assembly is provided which preferably includes a "U" shaped block having a movable jaw member disposed between the "U" leg portions of the jaw assembly. The movable jaw may be positioned so as to adjust the spacing between the jaw members and comprises a slidable member which is attached to the "U" shaped portion by an adjustment screw and at least one guide pin. The second jaw member comprises one leg of the "U" shaped portion of the jaw assembly, such that the movable jaw member may be moved with respect to the stationary jaw member by the adjustment screw.

Extending from the jaw assembly is the body of the climbing device, which includes a support surface which may be utilized as a foot hold by the construction worker to provide a standing platform once the climbing device is locked onto an I-beam or column. The body of the device also includes a lever mechanism which is spring biased to vary the spacing between the jaws by controlling the position of a piston member which passes from the body of the climbing device through the second jaw member and terminates at a point adjacent the first jaw member. Squeezing the handle portion of the lever mechanism moves the piston member away from the first jaw member, to permit the user to place the climbing device over a portion of the I-beam or column, in between the two jaw members. Releasing the handle of the lever mechanism moves the piston back towards the first jaw member to lock the climbing device onto the I-beam between the jaw members.

It is contemplated that the first jaw member may include a plurality of raised, hardened steel points, which enhance the gripping function of the climbing device by "biting" into the steel once the lever mechanism is released. In a second embodiment, it is contemplated that the piston member terminates at the movable jaw, so that as the handle is squeezed the movable jaw moves away from the stationary jaw to increase the spacing between the jaws to permit the user to lock on to an I-beam or column. In this instance, both opposed faces of the jaws members preferably include the grip enhancing points, so that as the lever mechanism is released, the piston moves the first jaw towards the second jaw to permit the grip enhancing points to "bite" onto the I-beam or column.

The climbing device of the present invention is further contemplated for use with a safety device such as a tether or a harness, and includes an eyelet for connection to such a device. The safety harness would be worn by the construction worker and include at least one of the climbing devices, so that the worker merely locks onto the I-beam or column quickly and securely by squeezing the lever/handle mechanism to open the jaws and then releasing the lever/handle mechanism to close the jaws.

In such an embodiment, the support member, which is used as a foot hold, may be eliminated from the device to facilitate carrying the device on the harness. In such a device, the jaw assembly fits directly into the palm of the worker's hand. A plunger mechanism may take the place of the lever to move the piston member to vary the space between the jaws. Depressing the plunger moves the piston away from the first jaw to allow the user to lock on the I-beam. In this embodiment, a tether connects the climbing device to a belt or harness worn by the user, thus reducing the chances for a fall by the worker in the event of an accidental slippage. The climbing device may be carried by the user when not in use by attaching to the belt or harness through any suitable connection, for example, a hook and loop fabric connection.

The climbing device of the present invention may be utilized to attach to any building structure, such as the frame of a building under construction, a bridge frame for general construction and general maintenance work, completed structures such as warehouses and other buildings having girder or I-beam frames, and the like. The climbing device is utilized to provide a foothold to the user, and a means to attach the user, through a tether arrangement, to the structure to reduce the possibility of a fall through accidental slippage.

BRIEF DESCRIPTION OF THE DRAWINGS

These features and other features of the present invention will become more readily apparent as described in the following detailed description of the preferred embodiments, taken in conjunction with the accompanying drawings, in which.

DETAILED DESCRIPTION OF THE PREFERRED EMBODIMENTS

Figure 1:
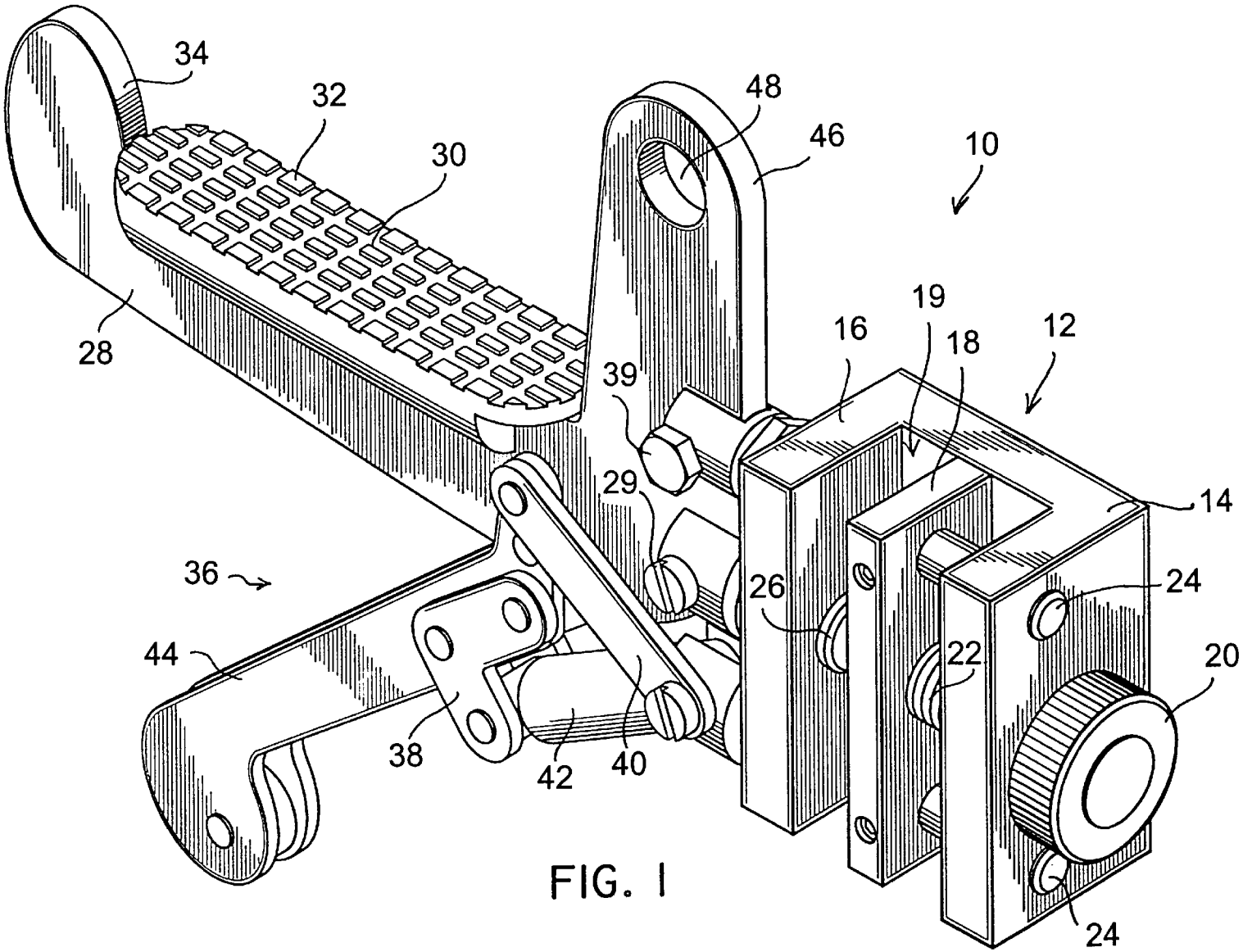
FIG. 1 illustrates a perspective view of the climbing device of the present invention.

Turning now to the drawings, in which like reference numerals identify similar or identical elements throughout the several views, the climbing device 10 of the present invention is illustrated in FIG. 1. Device 10 is preferably constructed of a metal material such as steel in order to support the weight of a person using the device and to prevent damage to the device during use. However, other suitable materials having a high impact strength or hardness may be utilized.

Climbing device 10, as seen in FIG. 1, includes a jaw assembly 12 constructed of a "U" shaped frame 14 in which one of the legs of the "U" shaped frame defines a second jaw member 16 while a movable first jaw 18 is provided within the "U" shaped frame 14 as shown. Movable first jaw member 18 may be moved to adjust the spacing 19 between the first and second jaw members, and as shown in FIG. 1 is moved through the provision of an adjustment knob 20 which rotates adjustment screw 22. Movable jaw 18 advances along guide pins 24, so that the distance between the first jaw member 18 and the second jaw member 16 may be varied to accommodate varying sizes of building frames, in particular I-beams or columns. Once the spacing 19 is set, device 10 may be secured to the building frame in a manner such as described below.

Second jaw member 16 preferably includes an aperture through which a movable piston member 26 passes. Piston member 26 is connected to the body support member 28 through the provision of bolt 29. Support member 28 extends generally perpendicular to the generally parallel first and second jaw members, and support member 28 preferably includes support foot plate 30 to provide a foot hold for a user. Foot plate 30 may include a plurality of grip members 32 to reduce the possibility of slippage when a user is standing on the climbing device 10. A back plate 34 may be provided to prevent the user's foot from slipping off the back end of the support member during use.

After spacing 19 is adjusted, the climbing device 10 may be attached to the I-beam by moving piston member 26 away from first jaw member 18. A lever member 36 is provided which includes a lever handle 44. As stated above, piston member 26 is secured to the support member 28 through bolt 29. Lever handle 44 is secured to support member 28 through the provision of spring link 38 and lever link 40 which serve to pivot support member 28 about bolt 39 when lever handle 44 is moved towards support member 28. Linkages 38 and 40 extend the damping spring assembly 42 in a manner which will be described below.

Figure 8:
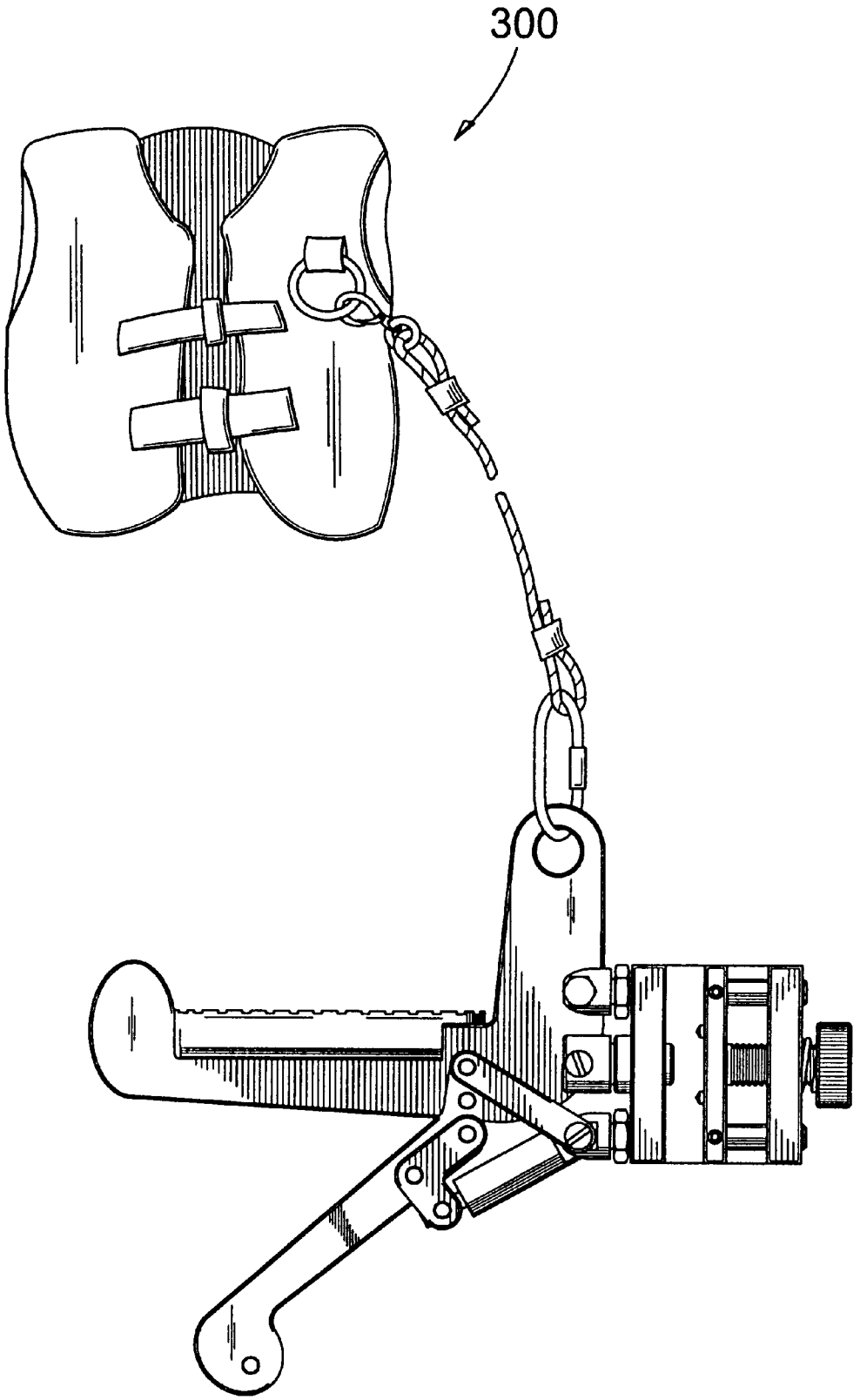
FIG. 8 illustrates the device of FIG. 2 connected to a safety harness or vest to be worn by a user.

Climbing device 10 may include a tether attachment portion 46 having an eyelet 48 for connection to a tether line, such as a rope or other safety device. It is also contemplated that eyelet 48 may connect to a tether which ultimately is connected to a harness vest or belt worn by the user, such as vest 300 shown in FIG. 8. Climbing device 10, once connected to the building frame, will not release until the lever handle 44 is once again squeezed in the direction towards support member 28, to disengage the piston member 26 from the I-beam. Accordingly, should a person using the climbing device slip and fall, the tether passing through eyelet 48 and attached to the user's body will reduce the possibility of a free fall.

Figure 2:
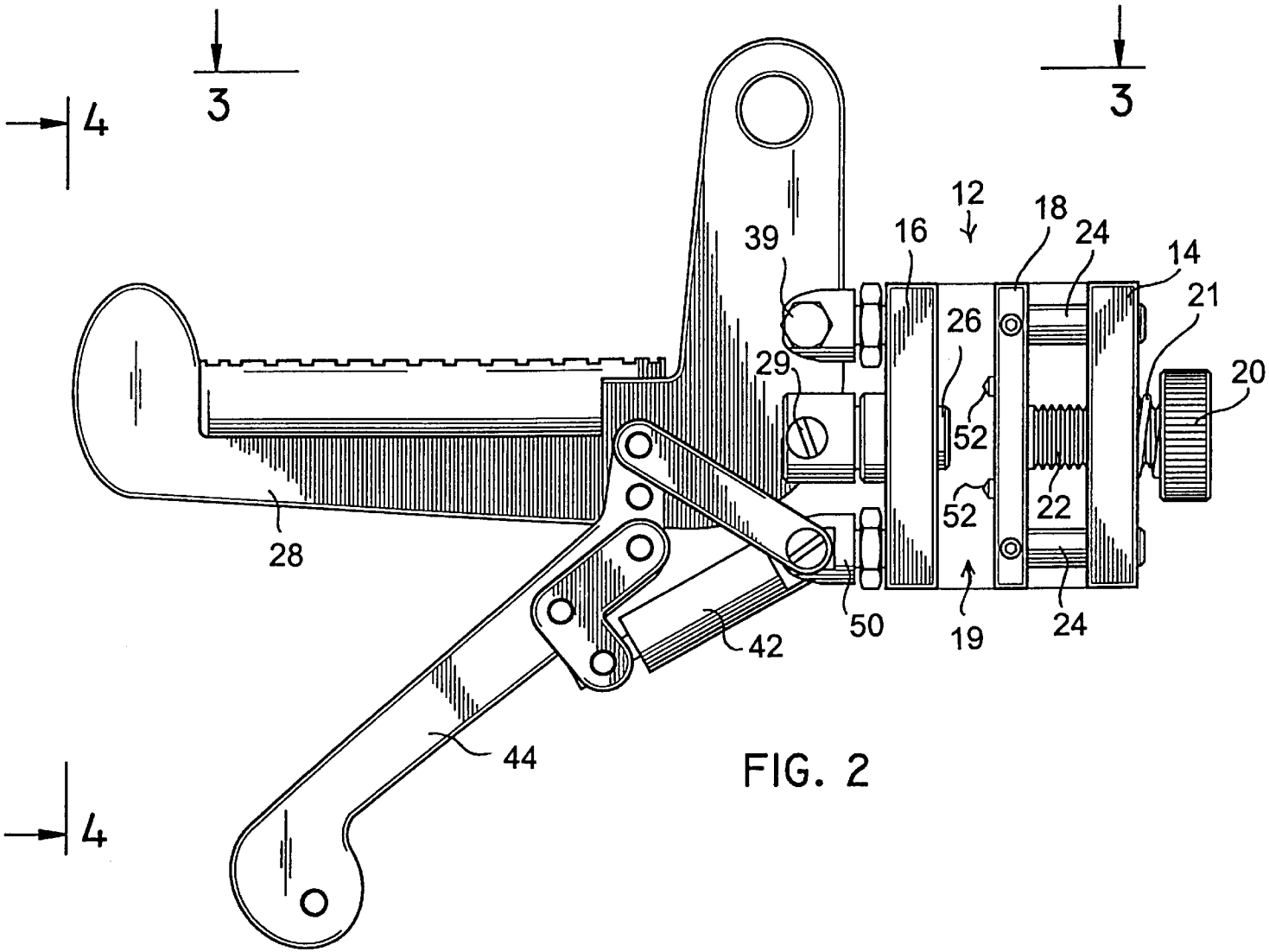
FIG. 2 illustrates a side elevational view of the climbing device of FIG. 1.

Turning now to FIG. 2, device 10 is shown in the at rest position in which lever handle 44 is in a position away from support member 28. In this position, piston member 26 extends through the face of second jaw member 16 as shown, and ultimately will cooperate with grip enhancing points 52 which protrude from the face of first jaw member 18. Adjustment screw 20 is preferably spring biased by adjustment spring 21, so that adjustment screw 22 only moves upon manual rotation of the knob 20.

Figure 5:
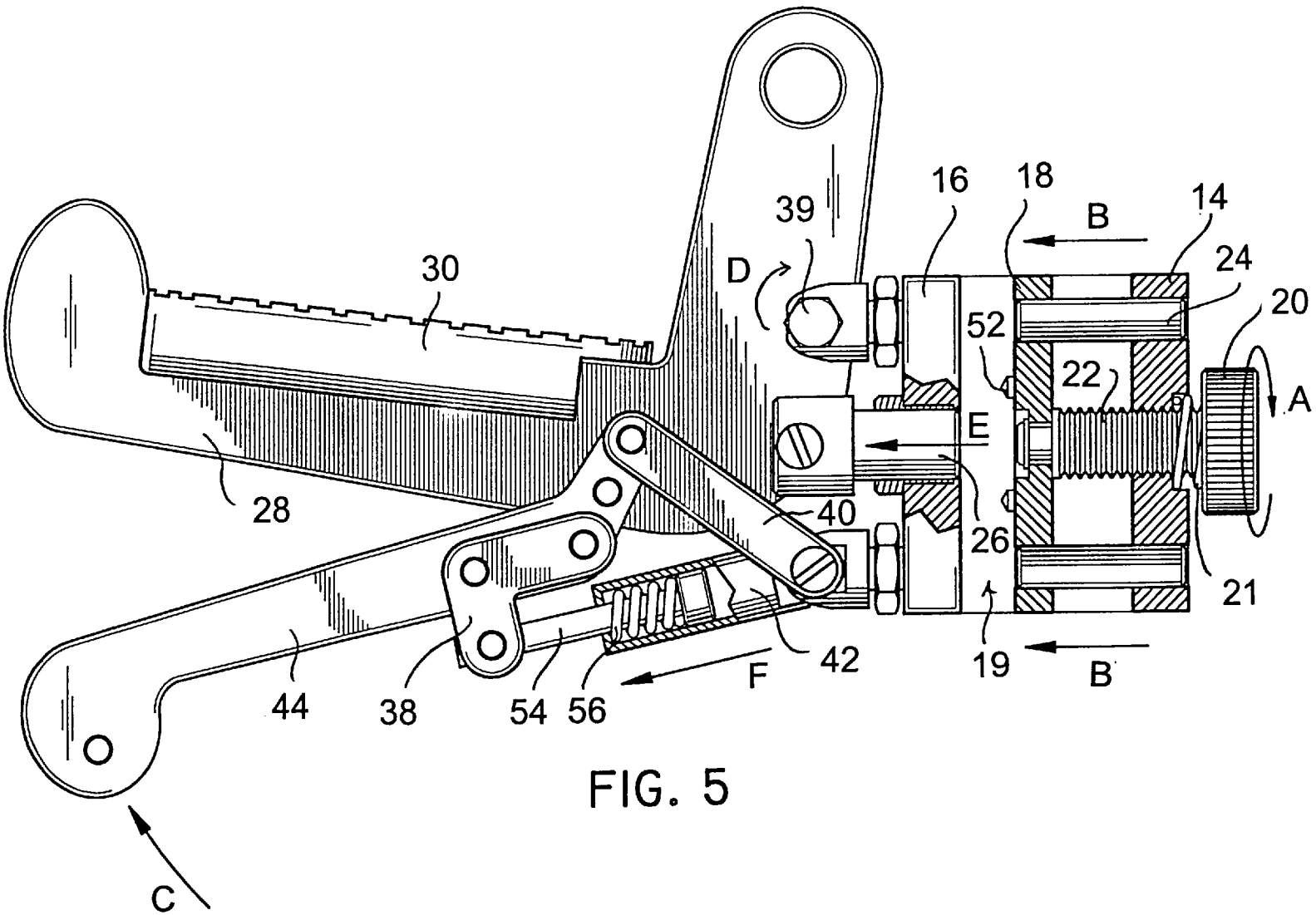
FIG. 5 illustrates a side elevational view, in partial cross-section, showing the operation of the climbing device of FIG. 1.

In use, as best seen in FIG. 5, the user rotates knob 20 in the direction of arrow "A" to move first jaw 18 along guide pins 24 in the direction of arrow "B" towards second jaw member 16. Once the spacing 19 is set, the user will squeeze the lever handle 44 in the direction of arrow "C" to cause support member 28 to rotate in the arrow of direction "D" about bolt 39. As this occurs, piston member 26 is drawn in the direction of arrow "E" and in effect increases the space 19 with respect to the grip enhancing points 52. When lever handle 44 is moved in the direction of arrow "C", the linkages 38 and 40 cause the damping plunger 54 to extend in the direction of arrow "F" against the biasing of damping spring 56 of damping spring assembly 42, until the user releases lever handle 44. When the handle is released, climbing device 10 returns to the position shown in FIG. 2, and a portion of the I-beam or column is grasped between piston member 26 and grip enhancing points 52. The grip enhancing points 52 are preferably constructed of a hardened steel material which in effect "bite" into the I-beam or column to lock the I-beam or column between jaw members 18 and 16.

Figure 6:
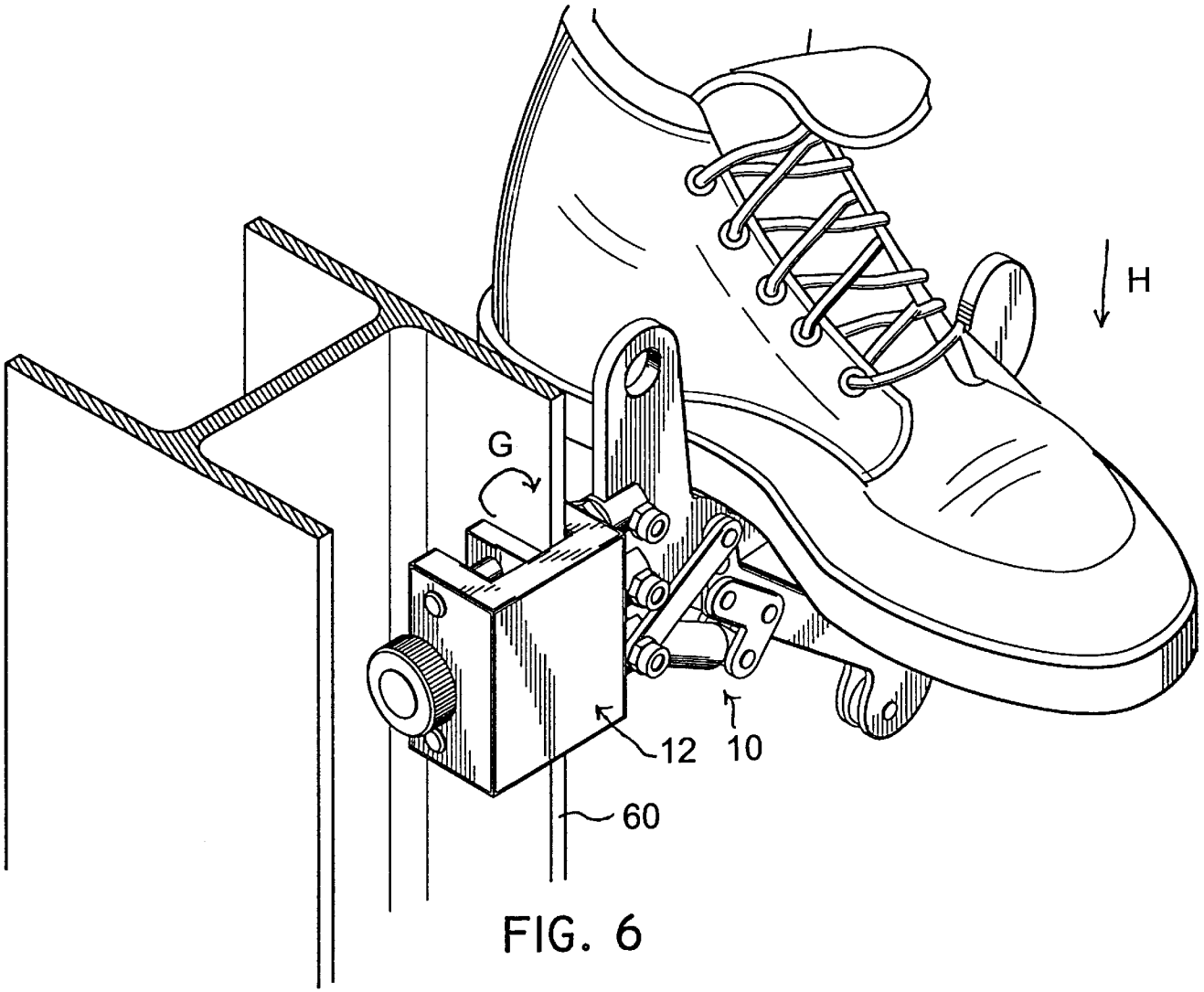
FIG. 6 illustrates a perspective view of the climbing device in use attached to an I-beam of a building frame.

As seen in FIG. 6, once the climbing device is positioned on the I-beam 60, the user may step on the support foot plate 30 of the support member 26, which creates a downward force in the direction of arrow "H". Referring to FIG. 2, this causes the support member 28 to rotate in a counterclockwise direction about bolt 39 and force piston member 26 further through the face of second jaw member 16 to provide a greater force on the I-beam. Furthermore, the downward force "H", as seen in FIG. 6, creates a moment force in the direction of arrow "G" which drives the grip enhancing points 52 into the I-beam 60 with greater force to lock the climbing device 10 in place.

Figure 3:
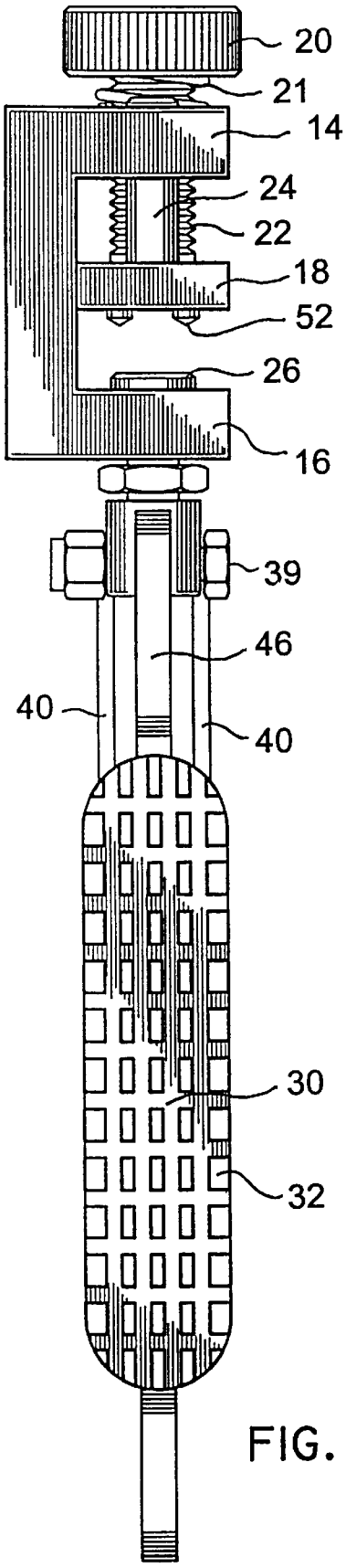
FIG. 3 illustrates a top plan view of the climbing device taken along lines 3—3 of FIG. 2.
Figure 4:
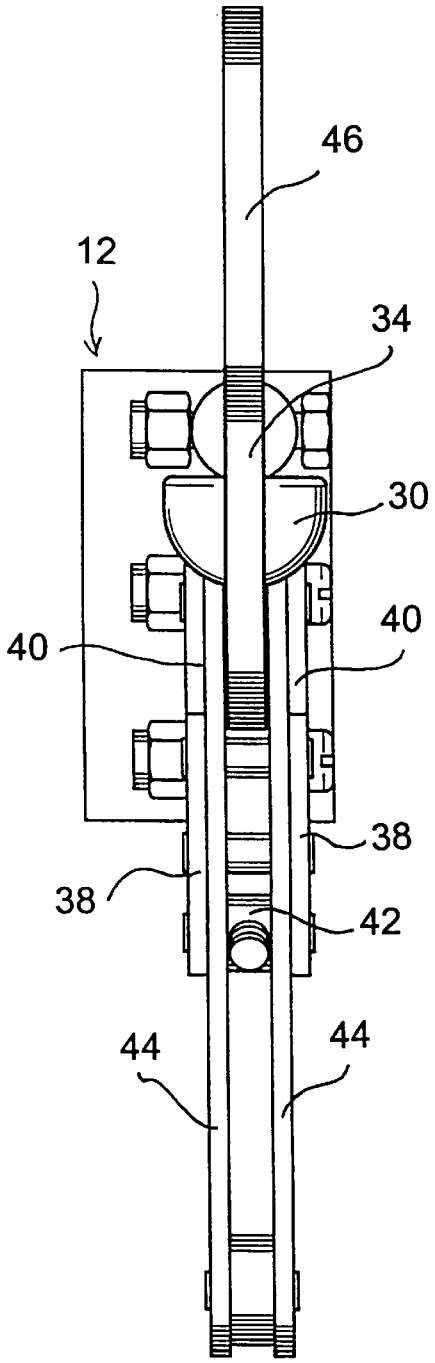
FIG. 4 illustrates a rear elevational view of the climbing device taken along lines 4—4 of FIG. 2.

As seen in FIGS. 3 and 4, linkages 38 and 40 are disposed on both sides of the support member 28. While this is shown in the present embodiment, it is also contemplated that a single linkage for each of linkages 38 and 40 may be utilized if desired.

Figure 2A:
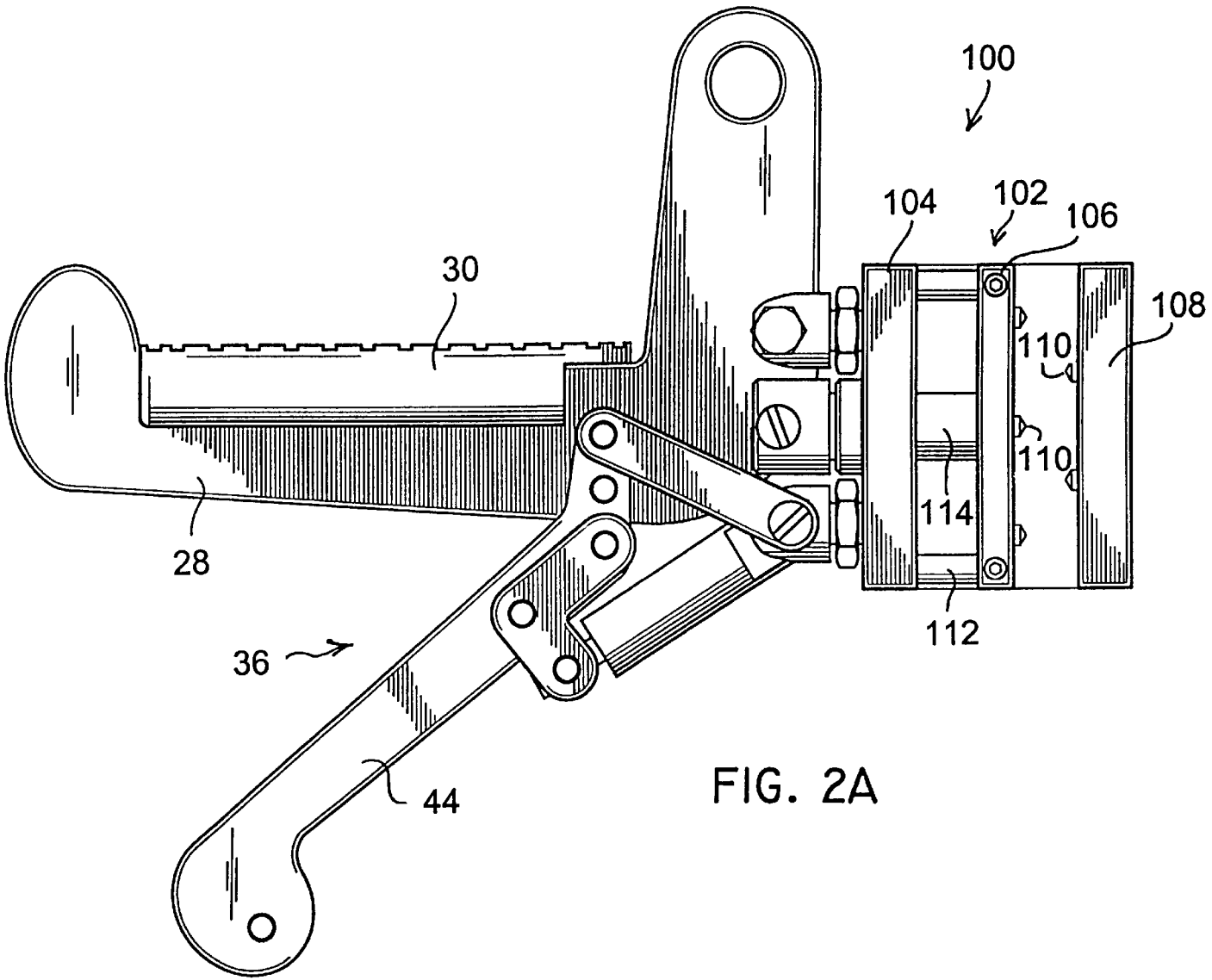
FIG. 2A illustrates a side elevational view of an alternate embodiment of the jaw mechanism of the climbing device of FIG. 1.

FIG. 2A illustrates an alternate embodiment of the jaw mechanism of the climbing device. In FIG. 2A, climbing device 100 includes a jaw assembly 102 in which the first movable jaw member 106 is secured directly to the piston member 114. In this device, second jaw 108 is part of the "U" shaped frame 104 as described with respect to FIG. 1 above. First jaw member 106 moves along with the piston member 114 along guide pins 112, and it is contemplated that both jaw members may include the grip enhancing points 110 as shown. The device of FIG. 2A operates in a manner similar to that described above with respect to FIG. 2, except that squeezing of the lever handle 44 of the lever mechanism 36 draws the piston member 114, and consequently the first jaw member 106 in a direction away from second jaw member 108. Releasing the lever handle 44 moves the first jaw member 106 towards second jaw member 108 to lock the climbing device 100 onto an I-beam or column, similar to that as described above.

Figure 7:
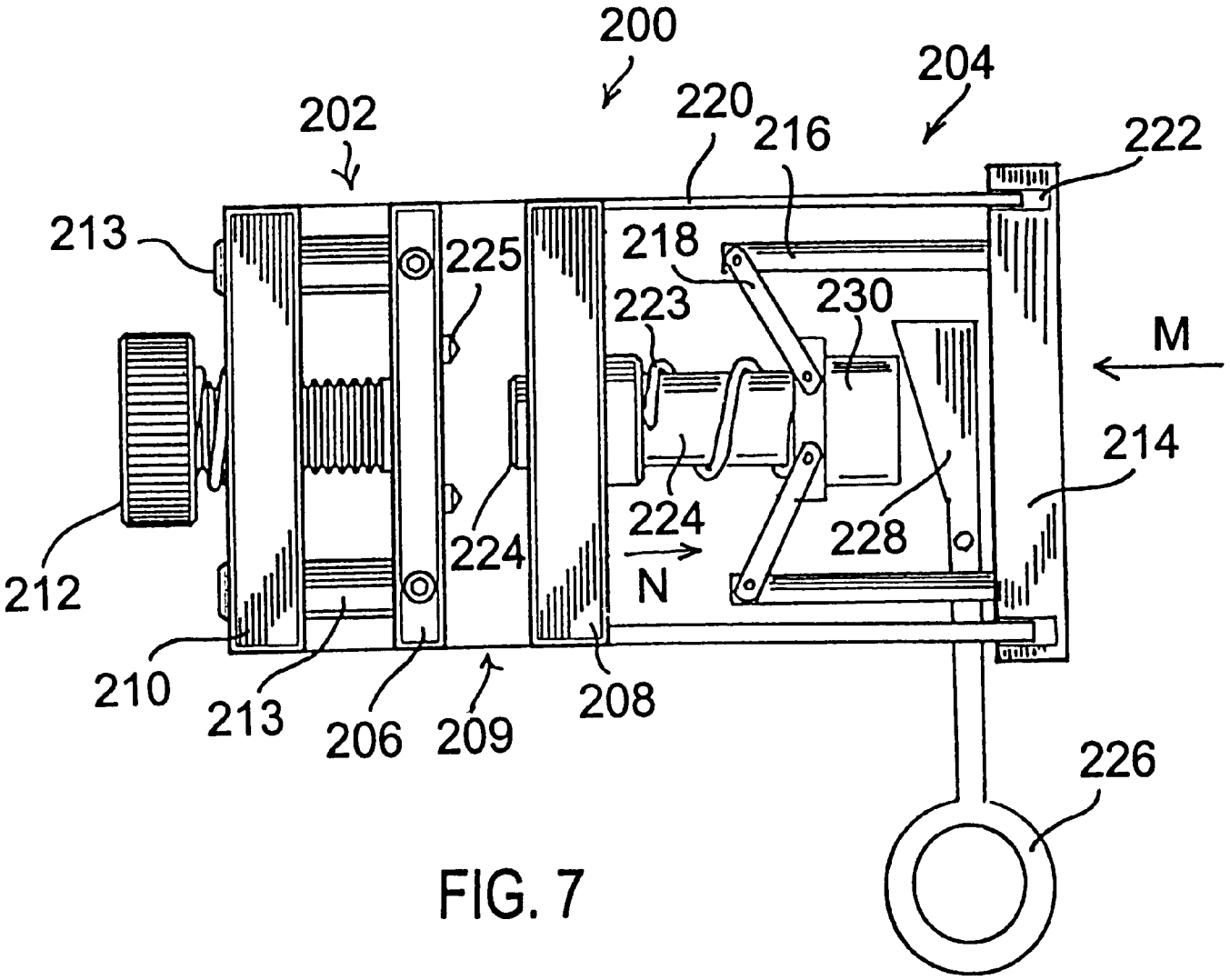
FIG. 7 illustrates a side elevational view of a further embodiment of the climbing device.

FIG. 7 illustrates a further embodiment of the climbing device according to the present invention. Climbing device 200 includes a jaw mechanism 202 which is similar to that described above with respect to FIGS. 1 and 2. Jaw mechanism 202 is part of a frame 204 which includes the jaw mechanism and the mechanism to actuate the jaws. It is contemplated that climbing device 200 is dimensioned to fit within the hand of a user to permit rapid deployment of the device by the construction worker utilizing the device.

Jaw mechanism 202 includes a first movable jaw 206 and a stationary second jaw 208 which are constructed in a manner similar to that described above with respect to FIGS. 1 and 2. End member 210 is part of the frame assembly 204, and holds rotation knob 212 which permits the adjustable movement of first jaw 206 along guide pins 213. Rotation of knob 212 moves the first jaw 206 to adjust the spacing 209 between the first jaw 206 and the second jaw 208. The actuation mechanism includes a plunger member 214 which is secured to the frame 204 and is movable with respect to the frame in tracks 222. The actuation mechanism includes linkage members 216 and 218 which upon movement of the plunger member 214 in the direction of arrow "M", causes the piston member 224 to move in the direction of arrow "N" against the biasing of spring member 223. As this occurs, the face of the piston member 224 moves out of the spacing 209 between the jaw members 206 and 208, thus permitting the attachment of climbing device 200 to an I-beam of a building frame. When the plunger mechanism 214 is released, linkage members 216 and 218 cause the plunger to move back to the position shown in FIG. 7 to lock a portion of the building frame such as the I-beam in the spacing 209 between the face of the plunger 224 and the grip enhancing points 225 on the first jaw member 206.

Figure 9:
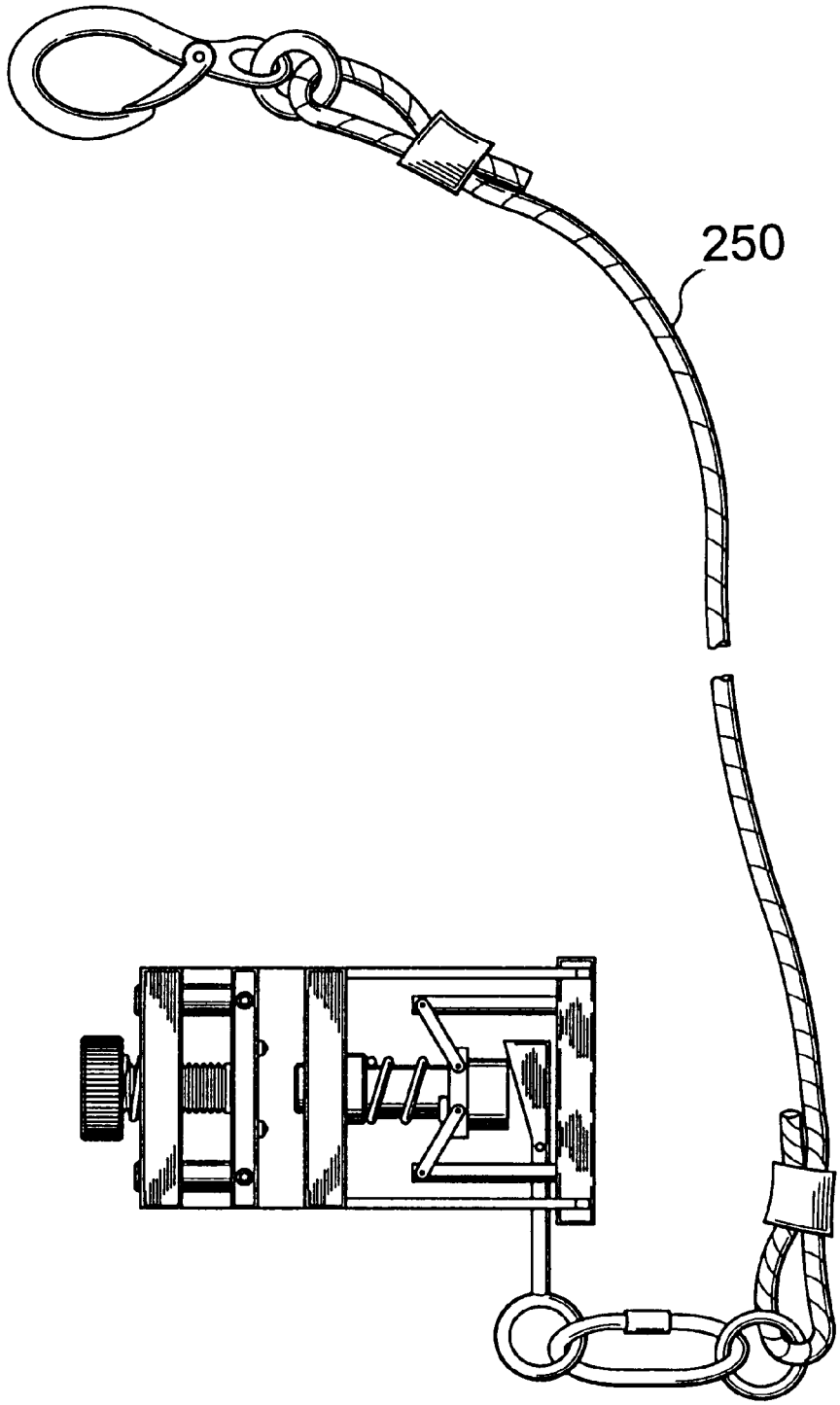
FIG. 9 illustrates the device of FIG. 7 including a rope tether for connection to a user.

In use, it is contemplated that the climbing device 200 includes some fastening means, such as a hook and loop fastener arrangement to permit the user to carry the climbing device 200 by attaching it to a belt or vest on the user's body. A tether or rope 250 is connected from the harness or belt worn by the user through eyelet 226, such as shown in FIG. 9. When the user desires to connect to a portion of the building frame, the climbing device 200 is removed from the belt or harness, and grasped in the palm of a hand of the user. Plunger member 214 is then depressed in the direction of arrow "M" to increase the spacing 209 between the jaw members, and then the plunger member 214 is released to lock the I-beam between the face of the piston member 224 and the grip enhancing points 225. The user is connected to the I-beam through the provision of the eyelet 226 which is attached to the harness or belt (not shown). With the climbing device 200 locked in place on the building frame, the safety of the user is ensured through the provision of the tether connected to the eyelet and to the user's harness or belt. Should the user accidently slip or fall, the tether will reduce the possibility of a free fall through the provision of the unique safety mechanism of the climbing device 200. This safety mechanism includes a pivotable arm 228 which will pivot in the direction of arrow "M" to engage piston block 230. As this occurs, the piston is driven in the direction of arrow "M" thus tightening the device as it is connected to the I-beam and preventing its slippage or removal. Thus, the weight of the user serves to enhance the locking ability of the climbing device 200 to the building frame.

While the present invention has been described with respect to the preferred embodiments, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. A climbing device for attachment to a portion of a building frame, comprising:

a generally U-shaped frame having two upwardly extending legs;

a first jaw member longitudinally slideable with respect to said upwardly extending legs of said U-shaped frame; and a reciprocating piston being movable with respect to said U-shaped frame from a first position to facilitate releasable engagement of the first jaw member and the piston about a portion of the building frame to a second position to releasably grasp the portion of the building frame between said jaw member and said reciprocating piston and secure said climbing device to said building frame.

2. A climbing device according to claim 1 further comprising a support member having a step platform to accommodate at least a foot of a user standing on said step platform, such that the users weight creates a moment force between said first jaw member and said piston to further grasp said building frame.

3. A climbing device according to claim 1, wherein said first jaw member faces includes raised grip enhancing members to facilitate grasping of said building frame.

4. A climbing device according to claim 1, further comprising a lever mechanism for moving the reciprocating piston between said first and said second positions, said lever mechanism being spring biased.

5. A climbing device according to claim 1, further comprising a connection point for attaching the climbing device to a user.

6. A climbing device according to claim 5 further comprising a tether line which attaches to said connection point.

7. A climbing device according to claim 5 further comprising a harness which attaches to said connection point.

8. A climbing device according to claim 1 further comprising an adjustment mechanism for moving said first jaw member relative to said U-shaped frame.

* * * * *